United States Patent [19]

Pliefke

[11] Patent Number: 4,671,859

[45] Date of Patent: Jun. 9, 1987

[54] PROCESS FOR THE ELECTROCHEMICAL GRAINING OF ALUMINUM FOR USE AS PRINTING PLATE SUPPORTS

[75] Inventor: Engelbert Pliefke, Wiesbaden, Fed. Rep. of Germany

[73] Assignee: Hoeschst Aktiengesellschaft, Frankfurt am Main, Fed. Rep. of Germany

[21] Appl. No.: 909,311

[22] Filed: Sep. 19, 1986

[30] Foreign Application Priority Data

Sep. 20, 1985 [DE] Fed. Rep. of Germany ..... 3533532

[51] Int. Cl.[4] ..... C25F 3/04

[52] U.S. Cl. ..... 204/129.95

[58] Field of Search ..... 204/129.85, 129.95

[56] References Cited

U.S. PATENT DOCUMENTS

| | | | |
|---|---|---|---|
| 3,193,485 | 7/1965 | Vincent | 204/141 |
| 3,632,486 | 1/1972 | Herrmann | 204/33 |
| 3,766,043 | 10/1973 | Herrmann et al. | 204/207 |
| 3,887,447 | 6/1975 | Sheasby et al. | 204/129.4 |
| 3,963,594 | 6/1976 | Brasko | 204/129.95 |
| 3,980,539 | 9/1976 | Lloyd et al. | 204/129.75 |
| 4,052,275 | 10/1977 | Gimbrinner et al. | 204/129.95 |
| 4,072,589 | 2/1978 | Golda et al. | 204/129.4 |
| 4,087,341 | 5/1978 | Takahashi et al. | 204/129.43 |
| 4,172,772 | 10/1979 | Ould et al. | 204/129.85 |
| 4,272,342 | 6/1981 | Oda et al. | 204/129.4 |
| 4,294,672 | 10/1981 | Ohba et al. | 204/129.4 |
| 4,301,229 | 11/1981 | Sakaki et al. | 430/158 |
| 4,468,295 | 8/1984 | Pliefke | 204/33 |
| 4,482,434 | 11/1984 | Pliefke | 204/33 |

FOREIGN PATENT DOCUMENTS

| | | | |
|---|---|---|---|
| 0036672 | 11/1983 | European Pat. Off. | 204/129.95 |
| 120061 | 2/1900 | Fed. Rep. of Germany | 204/129.75 |
| 1926809 | 12/1970 | Fed. Rep. of Germany | 204/129.95 |
| 3012135 | 10/1980 | Fed. Rep. of Germany | 204/129.95 |
| 91344/78 | 2/1980 | Japan | 204/129.75 |
| 93108/78 | 2/1980 | Japan | 204/129.95 |
| 105471/78 | 3/1980 | Japan | 204/129.95 |
| 879768 | 10/1961 | United Kingdom | 204/129.75 |
| 1400918 | 7/1975 | United Kingdom | 204/129.75 |
| 1544315 | 4/1979 | United Kingdom | 204/129.4 |
| 2047274 | 11/1980 | United Kingdom | 204/129.75 |
| 2053272 | 2/1981 | United Kingdom | 204/129.4 |
| 2127435 | 4/1984 | United Kingdom | 204/129.4 |

OTHER PUBLICATIONS

S. Kikuchi, "Electrolytic Etching Method of Aluminum Sheet for Printing Plate, "Patent Abstracts of Japan", vol. 7, No. 39, 2/83.

"The Alternating Current Etching of Aluminum Lithographic Sheet", A. J. Dowell, published in Transactions of the Institute of Metal Finishing, 1979, vol. 57, pp. 138–144.

*Primary Examiner*—T. M. Tufariello

*Attorney, Agent, or Firm*—Schwartz, Jeffery, Schwaab, Mack, Blumenthal & Evans

[57] ABSTRACT

The present invention relates to a process for the electrochemical graining of aluminum or aluminum alloys useful for printing plate supports, in which process an acid electrolyte containing $\beta$-diketo compounds is employed; preferred are hydrochloric or nitric acid with an acetylacetone admixture. The printing plate supports grained by the process possess a particularly uniform, pit-free and overall graining structure.

20 Claims, No Drawings

PROCESS FOR THE ELECTROCHEMICAL GRAINING OF ALUMINUM FOR USE AS PRINTING PLATE SUPPORTS

BACKGROUND OF THE INVENTION

The present invention relates to a process for the electrochemical graining of aluminum for use as printing plate supports, the process being performed by means of an alternating current in an acid electrolyte containing $\beta$-diketo compounds.

Printing plates (this term referring to offset-printing plates, within the scope of the present invention) usually comprise a support and at least one radiation-sensitive (photosensitive) reproduction layer arranged thereon, the layer being applied to the support either by the user (in the case of plates which are not pre-coated) or by the industrial manufacturer (in the case of pre-coated plates).

As a layer support material, aluminum or alloys thereof have gained general acceptance in the field of printing plates. In principle, it is possible to use these supports without modifying pretreatment, but they are generally modified in or on their surfaces, for example, by a mechanical, chemical and/or electrochemical roughening process (also called graining or etching in the literature), a chemical or electrochemical oxidation process and/or a treatment with hydrophilizing agents. In the modern, continuously working high-speed equipment employed by the manufacturers of printing plate supports and/or pre-coated printing plates, a combination of the aforementioned modifying methods is frequently used, particularly a combination of electrochemical graining and anodic oxidation, optionally followed by a hydrophilizing step.

Graining is, for example, carried out in aqueous acids, such as aqueous solutions of HCl or $HNO_3$ or in aqueous salt solutions, such as aqueous solutions of NaCl or $Al(NO_3)_3$, using an alternating current. The peak-to-valley heights (specified, for example, as mean peak-to-valley heights $R_z$) of the grained surface, which can thus be obtained, are in the range from about 1 to 15 $\mu$m, particularly in the range from 2 to 8 $\mu$m. The peak-to-valley height is determined according to DIN 4768 (in the October 1970 version). The peak-to-valley height $R_z$ is then the arithmetic mean calculated from the individual peak-to-valley height values of five mutually adjacent individual measurement lengths.

Graining is, inter alia, carried out in order to improve the adhesion of the reproduction layer to the support and to improve the water/ink balance of the printing form which results from the printing plate upon irradiation (exposure) and developing. By irradiating and developing (or decoating, in the case of electrophotographically-working reproduction layers), the ink-receptive image areas and the water-retaining non-image areas (generally the bared support surface) in the subsequent printing operation, are produced on the printing plate, and thus the actual printing form is obtained. The final topography of the aluminum surface to be grained is influenced by various parameters. By way of example, the following passages from the literature supply information about these parameters:

The paper "The Alternating Current Etching of Aluminum Lithographic Sheet", by A. J. Dowell, published in Transactions of the Institute of Metal Finishing, 1979, Vol. 57, pages 138 to 144, presents basic comments on the graining of aluminum in aqueous solutions of hydrochloric acid, based on variations of the following process parameters and an investigation of the corresponding effects. The electrolyte composition is changed during repeated use of the electrolyte, for example, in view of the $H^+(H_3O^+)$ ion concentration (measurable by means of the pH) and in view of the $Al^{3+}$ ion concentration, with influences on the surface topography being observed. Temperature variations between 16° C. and 90° C. do not show an influence causing changes until temperatures are about 50° C. or higher, the influence becoming apparent, for example, as a significant decrease in layer formation on the surface. Variations in graining time between 2 and 25 minutes lead to an increasing metal dissolution with increasing duration of action. Variations in current density between 2 and 8 A/dm$^2$ result in higher roughness values with rising current density. If the acid concentration is in a range from 0.17 to 3.3% of HCl, only negligible changes in pit structure occur between 0.5 and 2% of HCl, whereas below 0.5% of HCl, the surface is only locally attacked, and at the high values, an irregular dissolution of aluminum takes place. An addition of $SO_4^{2-}$ ions or $Cl^-$ ions in the form of salts (e.g., by adding $Al_2(SO_4)_3$ or NaCl) can also influence the topography of the grained aluminum. Rectification of the alternating current shows that both half-wave types are necessary to obtain a uniform graining.

The use of hydrochloric acid as an electrolyte in the graining of aluminum substrates is thus to be considered as being basically known in the art. A uniform graining can be obtained, which is appropriate for lithographic plates and is within a useful roughness range. In pure hydrochloric acid electrolytes adjustment of an even and uniform surface topography is difficult and it is necessary to keep the operating conditions within very close limits.

The influence of the electrolyte composition on the quality of graining is, for example, also described in the following publications:

German Offenlegungsschrift No. 22 50 275 (=British Patent Specification No. 1,400,918) specifies aqueous solutions containing from 1.0 to 1.5% by weight of $HNO_3$ or from 0.4 to 0.6% by weight of HCl and optionally from 0.4 to 0.6% by weight of $H_3PO_4$, for use as electrolytes in the graining of aluminum for printing plate supports, by means of an alternating current, U.S. Pat. No. 4,072,589 mentions aqueous solutions containing from 0.2 to 1.0% by weight of HCl and from 0.8 to 6.0% by weight of $HNO_3$ as electrolytes in the graining of aluminum employing an alternating current.

Additives used in the HCl electrolyte serve the purpose of preventing an adverse local attack in the form of deep pits. The following additives to hydrochloric acid electrolytes are, for example, described:

in U.S. Pat. No. 4,172,772: monocarboxylic acids, such as acetic acid, in U.S. Pat. No. 3,963,594: gluconic acid, in European Patent Application No. 0 036 672: citric acid and malonic acid and in U.S. Pat. No. 4,052,275: tartaric acid.

All these organic electrolyte components have the disadvantage of being electrochemically instable and decomposing in the case of a high current load (voltage).

Inhibiting additives, for example, phosphoric acid and chromic acid as described in U.S. Pat. No. 3,887,447 or boric acid as described in U.S. Pat. No.

3,980,539 have the disadvantage that there is often a local breakdown of the protective effect and individual, particularly pronounced pits can form in these places.

Japanese Patent Application No. 91 334/78 describes graining by means of an alternating current in a composition comprising a combination of hydrochloric acid and an alkali-metal halide, to produce a lithographic support material.

U.S. Pat. No. 3,632,486 and No. 3,766,043 describe graining by means of a direct current, for example, for decorative panellings, using dilute hydrofluoric acid, whereby the aluminum is switched such that it forms the anode.

German Pat. No. 120 061 describes a treatment for generating a hydrophilic layer by the application of electric current, which treatment can also be performed in hydrofluoric acid.

Japanese Patent Application No. 93 108/78 describes the production of a capacitor film; in the process, graining is first carried out in an electrolyte comprising from 0.3 to 1.5% of hydrochloric acid and from 15 to 25% of ammonium acetate using an alternating current (at 200 to 400 C/dm$^2$), and electrolysis is then continued in HCl using a pulsed current.

Japanese Patent Application No. 105 471/78 claims 0.3 to 1.5% of $HNO_3$ and 1 to 3.0% of citric acid, in addition to 15 to 25% of ammonium acetate.

However, a treatment of this kind in electrolyte systems with a pH exceeding 4.5 leads to surface structures which are coarsely pitted and/or do not show an overall graining and which hence are entirely unsuited for lithographic purposes. Contrary to surface enlargement which is desired for the application in capacitors, roughening of printing plate supports serves to produce layer anchoring and water/ink balance and must therefore be very homogeneous and free from pits.

The use of acetylacetone in ordinary metal cleaning agents is, for example, described in German Offenlegungsschrift No. 19 26 809. The object of the present invention is, however, to produce a support material which is suitable for lithographic purposes and, therefore, must exhibit an extremely homogeneous surface topography.

Another known possibility for improving the uniformity of electrochemical roughening comprises a modification of the type of electric current employed, including, for example, using an alternating current, in which the anodic voltage and the anodic coulombic input are higher than the cathodic voltage and the cathodic coulombic input, according to U.S. Pat. No. 4,087,341, the anodic half-cycle period of the alternating current being generally adjusted to be less than the cathodic half-cycle period; this method is, for example, also referred to in U.S. Pat. No. 4,301,229, German Offenlegungsschrift No. 30 12 135 (=published UK Patent Application No. 2,047,274) or U.S. Pat. No. 4,272,342, using an alternating current, in which the anodic voltage is markedly increased compared with the cathodic voltage, according to U.S. Pat. No. 3,193,485, interrupting the current flow for 10 to 120 seconds and re-applying current for 30 to 300 seconds, using an alternating current and, as the electrolyte, an aqueous solution of 0.75 to 2.0 N HCl, with the addition of NaCl or $MgCl_2$, according to British Patent No. 879,768. A similar process comprising an interruption of current flow in the anodic or cathodic phase is also disclosed in German Offenlegungsschrift No. 30 20 420 (=U.S. Pat. No. 4,294,672).

The aforementioned methods may lead to relatively uniformly grained aluminum surfaces, but they sometimes require a comparatively great equipment expenditure and, in addition, are applicable only within closely limited parameters.

SUMMARY OF THE INVENTION

It is therefore an object of the present invention to provide a process for the electrochemical graining of aluminum for use in printing plate supports which process results in a uniform, pit-free and overall graining structure and which can be performed without great equipment expenditure and/or closely limited parameters.

It is another object of the present invention to provide a process for making aluminum or aluminum alloy printing plate supports with a uniform surface grain in order to facilitate adhesion of a reproduction layer to the printing plate supports.

In accordance with the present invention, there has been provided a process for the electrochemical graining of a printing plate support comprised of aluminum or an aluminum alloy, comprising the step of subjecting an aluminum or aluminum alloy printing plate support to an electric current in a solution comprised of an acid electrolyte and at least one $\beta$-diketo compound.

Further objects, features and advantages of the present invention will become apparent from the detailed description of preferred embodiments which follows.

DETAILED DESCRIPTION OF THE PREFERRED EMBODIMENTS

The invention is based on a process for the electrochemical graining of aluminum or aluminum alloys useful for printing plate supports, in an acid electrolyte under the action of electric current.

Thereby, preference is given to alternating current. It is, however, also possible to obtain surfaces which are well-suited for lithographic purposes by employing an anodic direct current in the electrolyte of this invention (see Examples 30 to 32).

The process of this invention is characterized in that an acid electrolyte is used, which contains a $\beta$-diketo compound.

In a preferred embodiment, a HCl or $HNO_3$ electrolyte is employed, in which the acid concentration ranges between 0.01 and 50 g/l, preferably between 0.01 and 30 g/l, and the concentration of the, $\beta$-diketo compound ranges between 3 g/l and the saturation limit, preferably between 40 g/l and the saturation limit.

Acetylacetone is the most preferred $\beta$-diketo compound. In accordance with the invention it is also possible, however, to use combinations of $\beta$-diketo compounds, as long as the pH value is kept acidic.

It has proved to be particularly advantageous, if the electrolyte is additionally admixed with aluminum salts, preferably in an amount from 20 to 150 g/l.

For carrying out the process of the present invention, the amount of hydrochloric acid, which is set free by hydrolysis of aluminum chloride, may already be sufficient.

A surface produced according to the process of the present invention results in an extremely even ($R_z$=2 to 5 $\mu$m), highly uniform support surface having excellent lithographic properties.

The process of the invention is carried out either discontinuously or preferably continuously, using webs of aluminum or aluminum alloys. In continuous processes, the process parameters during graining are generally within the following ranges: temperature of the electrolyte between 20 and 60° C., current density between 3 and 130 A/dm$^2$, dwell time of a material spot to be grained in the electrolyte between 10 and 300 seconds, and rate of flow of the electrolyte on the surface of the material to be grained between 5 and 100 cm/second. In discontinuous processes, the required current densities are in the lower region and the dwell times in the upper region of the ranges indicated in each case; a flow of the electrolyte can even be dispensed with in these processes.

In addition to the current types mentioned in the description of the prior art, it is also possible to use superimposed alternating current and low-frequency currents.

The following materials which are in the form of a sheet, a foil or a web may, for example, be used for graining in the process of the invention:

"Pure aluminum" (DIN Material No. 3.0255), i.e., composed of more than 99.5% Al and the following permissible admixtures (maximum total 0.5%): 0.3% Si, 0.4% Fe, 0.03% Ti, 0.02% Cu, 0.07% Zn and 0.03% of other substances, or "Al-alloy 3003" (comparable to DIN Material No. 3.0515), i.e., composed of more than 98.5% Al, 0 to 0.3% Mg and 0.8 to 1.5% Mn, as alloying constituents, and 0.5% Si, 0.5% Fe, 0.2% Ti, 0.2% Zn, 0.1% Cu and 0.15% of other substances, as permissible admixtures.

The process of the present invention can, however, also be used with other aluminum alloys.

The electrochemical graining process according to the present invention may be followed by an anodic oxidation of the aluminum in a further process step, in order to improve, for example, the abrasive and adhesive properties of the surface of the support material.

Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. The following are standard methods for the use of aqueous $H_2SO_4$-containing electrolytes for the anodic oxidation of aluminum (see, e.g., M. Schenk, Werkstoff Aluminium und seine anodische Oxydation [The Material Aluminum and its Anodic Oxidation], Francke Verlag, Bern, 1948, page 760; Praktische Galvanotechnik [Practical Electroplating], Eugen G. Leuze Verlag, Saulgau, 1970, pages 395 et seq., 518–19; W. Huebner and C. T. Speiser, Die Praxis der anodischen Oxidation des Aluminiums [Practical Technology of the Anodic Oxidation of Aluminum], Aluminium Verlag, Duesseldorf, 1977, 3rd Edition, pages 137 et seq.):

The direct current sulfuric acid process, in which anodic oxidation is carried out in an aqueous electrolyte which conventionally contains approximately 230 g of $H_2SO_4$ per 1 liter of solution, for 10 to 60 minutes at 10° C. to 22° C., and at a current density of 0.5 to 2.5 A/dm$^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per 1 liter (or about 230 g of $H_2SO_4$ per liter), at an operating temperature of 0° to 5° C., and at a current density of 2 to 3 A/dm$^2$, for 30 to 200 minutes, at a voltage which rises from approximately 25 to 30 V at the beginning of the treatment, to approximately 40 to 100 V toward the end of the treatment.

In addition to the processes for the anodic oxidation of printing plate support materials which have already been mentioned in the preceding paragraph, the following processes can, for example, also be used: the anodic oxidation of aluminum can be carried out in an aqueous, $H_2SO_4$-containing electrolyte, in which the content of $Al^{3+}$ ions is adjusted to values exceeding 12 g/l, U.S. Pat. No. 4,211,619; in an aqueous electrolyte containing $H_2SO_4$ and $H_3PO_4$, U.S. Pat. No. 4,049,504; or in an aqueous electrolyte containing $H_2SO_4$, $H_3PO_4$ and $Al^{3+}$ ions, U.S. Pat. No. 4,229,226.

Direct current is preferably used for the anodic oxidation, but it is also possible to use alternating current or a combination of these types of current (for example, direct current with superimposed alternating current).

The layer weights of aluminum oxide range from about 1 to 10 g/m$^2$, which corresponds to layer thicknesses from about 0.3 to 3.0 $\mu$m. After the electrochemical graining step and prior to an anodic oxidation step, an etching modification of the roughened surface may additionally be performed, as described, for example, in German Offenlegungsschrift No. 30 09 103. A modifying intermediate treatment of this kind can, inter alia, enable the formation of abrasion-resistant oxide layers and reduce the tendency to scumming in the subsequent printing operation.

The anodic oxidation step of the aluminum support material for printing plates is optionally followed by one or more post-treatment steps. Post-treatment is particularly understood to be a hydrophilizing chemical or electrochemical treatment of the aluminum oxide layer, for example, an immersion treatment of the material in an aqueous solution of polyvinyl phosphonic acid according to German Pat. No. 16 21 478 (=British Pat. No. 1,230,447), an immersion treatment in an aqueous solution of an alkali-metal silicate according to U.S. Pat. No. 3,181,461, or an electrochemical treatment (anodization) in an aqueous solution of an alkali-metal silicate according to U.S. Pat. No. 3,902,976. These post-treatment steps serve, in particular, to even further improve the hydrophilic properties of the aluminum oxide layer, which are already sufficient for many fields of application, while maintaining the other well-known properties of the layer.

Suitable photosensitive reproduction layers comprise any layers which, after exposure, optionally followed by development and/or fixing, yield a surface in image configuration, which can be used for printing and/or which represents a relief image of an original. The layers are applied to the support materials, either by the manufacturer of presensitized printing plates or dry resists or directly by the user.

The photosensitive reproduction layers include those which are described, for example, in "Light-Sensitive Systems", by Jaromir Kosar, published by John Wiley & Sons, New York, 1965: layers containing unsaturated compounds, which, upon exposure, are isomerized, rearranged, cyclized, or crosslinked such as cinnamates (Kosar, Chapter 4); layers containing photopolymerizable compounds, in which layers monomers or prepolymers which can be photopolymerized undergo polymerization on being exposed, optionally with the aid of an initiator (Kosar, Chapter 5); and layers containing o-diazoquinones, such as naphthoquinone-diazides, p-diazoquinones, or condensation products of diazonium salts (Kosar, Chapter 7).

Other suitable layers include the electrophotographic layers, i.e. layers which contain an inorganic or organic photoconductor. In addition to the photosensitive substances, these layers can, of course, also contain other constituents, such as for example, resins, dyes, pigments, surfactants, sensitizers, adhesion promoters, indicators, plasticizers or other conventional auxiliary agents. In particular, the following photosensitive compositions or compounds can be employed in the coating of the support materials:

positive-working o-quinone diazide compounds, preferably o-naphthoquinone diazide compounds, which are described, for example, in German Pat. Nos. 854 890, 865 109, 879 203, 894 959, 938 233, 11 09 521, 11 44 705, 11 18 606, 11 20 273 and 11 24 817;

negative-working condensation products obtained from aromatic diazonium salts and compounds with active carbonyl groups, preferably condensation products formed from diphenylamine-diazonium salts and formaldehyde, which are described, for example, in German Pat. Nos. 596 731, 11 38 399, 11 38 400, 11 38 401, 11 42 871, and 11 54 123, U.S. Pat. Nos. 2,679,498 and 3,050,502, and British Pat. No. 712 606;

negative-working co-condensation products of aromatic diazonium compounds, for example, according to German Offenlegungsschrift No. 20 24 244, which possess, in each case, at least one unit of the general types $A(-D)_n$ and B, connected by a divalent linking member derived from a carbonyl compound which is capable of participating in a condensation reaction. In this context, these symbols are defined as follows: A is the radical of a compound which contains at least two aromatic carbocyclic and/or heterocyclic nuclei, and which is capable, in an acid medium, of participating in a condensation reaction with an active carbonyl compound, at one or more positions. D is a diazonium salt group which is bonded to an aromatic carbon atom of A; n is an integer from 1 to 10; and B is the radical of a compound which contains no diazonium groups and which is capable, in an acid medium, of participating in a condensation reaction with an active carbonyl compound, at one or more positions on the molecule;

positive-working layers according to German Offenlegungsschrift No. 26 10 842, which contain a compound which, on being irradiated, splits off an acid, a compound which possesses at least one C-O-C group which can be split off by acid (e.g., an orthocarboxylic acid ester group, or a carboxamideacetal group), and, if appropriate, a binder;

negative-working layers, composed of photo-polymerizable monomers, photo-initiators, binders and, if appropriate, further additives. In these layers, for example, acrylic and methacrylic acid esters or reaction products of diisocyanates with partial esters of polyhydric alcohols are employed as monomers, as described, for example, in U.S. Pat. Nos. 2,760,863 and 3,060,023, and in German Offenlegungsschriften Nos. 20 64 079 and 23 61 041.

Suitable photo-initiators are, inter alia, benzoin, benzoin ethers, polynuclear quinones, acridine derivatives, phenazine derivatives, quinoxaline derivatives, quinazoline derivatives, or synergistic mixtures of various ketones. A large number of soluble organic polymers can be employed as binders, for example, polyamides, polyesters, alkyd resins, polyvinyl alcohol, polyvinyl-pyrrolidone, polyethylene oxide, gelatin or cellulose ethers;

negative-working layers according to German Offenlegungsschrift No. 30 36 077, which contain, as the photosensitive compound, a diazonium salt polycondensation product or an organic azido compound, and which contain, as the binder, a high-molecular weight polymer with alkenylsulfonylurethane or cycloalkenylsulfonylurethane side groups.

It is also possible to apply photo-semiconducting layers to the support materials, such as described, for example, in German Pat. Nos. 11 17 391, 15 22 497, 15 72 312, 23 22 046 and 23 22 047, as a result of which highly photosensitive electrophotographic layers are produced.

The materials for printing plate supports, which have been grained according to the process of the present invention, exhibit a very uniform topography, which positively influences the stability of print runs and the water/ink balance during printing with printing forms manufactured from these supports. Compared with the use of pure hydrochloric acid electrolytes, "pits" (pronounced depressions, in comparison to the surrounding roughening) occur less frequently and can even be completely supressed; using the processes of the present invention it is, in particular, possible to also produce even, pit-free supports. Compared with the other examples, Comparative Examples 4, 13, and 29 show the effect of the addition of β-diketo compounds observing an acidic pH, as a means of obtaining surfaces which are evener and, nevertheless, uniform. These surface properties can be materialized without particularly great equipment expenditure.

EXAMPLES

An aluminum sheet (DIN Material No. 3.0255) is first pickled in an aqueous solution containing 20 g/l of NaOH, for 60 seconds, at room temperature. Graining is carried out in the electrolyte systems specified in each case.

The invention is, however, not limited to the illustrative examples.

The classification into quality grades (surface topography with respect to uniformity, absence of pits and overall graining) is effected by visual estimation under a microscope. Quality grade "1" (best grade) is assigned to a surface which is homogeneously grained and free from pits. Quality grade "10" (worst grade) is assigned to a surface showing great pits of more than 30 μm in size and/or an extremely ununiformly grained or almost mill-finished surface.

TABLE I

| Example No. | HCl g/l | $HNO_3$ g/l | $AlCl_3x6H_2O$ g/l | $Al(NO_3)_3xH_2O$ g/l | Type of β-diketo compound | β-Diketo-concentration g/l | a.c. density $A/dm^2$ | time sec | quality grades 1 = very good 10 = extremely poor |
|---|---|---|---|---|---|---|---|---|---|
| 1 | 10 | | 60 | | acetylacetone | 50 | 40 | 30 | 1–2 |
| 2 | 10 | | 60 | | acetylacetone | 50 | 60 | 13 | 1–2 |
| 3 | 10 | | 60 | | acetylacetone | 50 | 60 | 17 | 1–2 |
| 4 | 10 | | 60 | | — | — | 60 | 17 | 5 |

TABLE I-continued

| Example No. | HCl g/l | $HNO_3$ g/l | $AlCl_3x6H_2O$ g/l | $Al(NO_3)_3xH_2O$ g/l | Type of β-diketo compound | β-Diketo-concentration g/l | a.c. density A/dm² | time sec | quality grades 1 = very good 10 = extremely poor |
|---|---|---|---|---|---|---|---|---|---|
| 5 | 10 | | 60 | | acetylacetone | 10 | 40 | 15 | 1–2 |
| 6 | 10 | | — | | acetylacetone | 10 | 40 | 20 | 1–2 |
| 7 | 10 | | — | | acetylacetone | 10 | 40 | 25 | 1–2 |
| 8 | 10 | | — | | acetylacetone | 10 | 40 | 30 | 1 |
| 9 | 5 | | — | | acetylacetone | 75 | 40 | 25 | 2 |
| 10 | 5 | | 60 | | acetylacetone | 75 | 40 | 30 | 1–2 |
| 11 | 5 | | 60 | | acetylacetone | 75 | 60 | 17 | 1 |
| 12 | 5 | | 60 | | acetylacetone | 75 | 60 | 20 | 1 |
| 13 | 5 | | 60 | | — | — | 60 | 20 | 4–5 |
| 14 | 12 | | 50 | | acetylacetone | 100 | 60 | 17 | 2 |
| 15 | 12 | | 50 | | acetylacetone | 100 | 80 | 7 | 1–2 |
| 16 | 12 | | 50 | | acetylacetone | 100 | 80 | 13 | 1–2 |
| 17 | 12 | | 50 | | acetylacetone | 100 | 100 | 6 | 1–2 |
| 18 | 10 | | 60 | | dimedone | 12 | 40 | 15 | 2–3 |
| 19 | 10 | | 60 | | dimedone | 12 | 40 | 20 | 1–2 |
| 20 | 5 | | 30 | | dimedone | 12 | 40 | 20 | 1–2 |
| 21 | 5 | | 30 | | dimedone | 12 | 40 | 30 | 3 |
| 22 | | 15 | | 60 | acetylacetone | 100 | 100 | 6 | 2 |
| 23 | | 15 | | 60 | acetylacetone | 100 | 100 | 8 | 2 |
| 24 | | 15 | | 60 | acetylacetone | 100 | 80 | 13 | 1–2 |
| 25 | | 15 | | 60 | acetylacetone | 100 | 80 | 15 | 2 |
| 26 | | 15 | | 60 | acetylacetone | 100 | 40 | 30 | 1–2 |
| 27 | | 32 | | 60 | acetylacetone | 100 | 80 | 13 | 2–3 |
| 28 | | 15 | | 60 | acetylacetone | 100 | 40 | 25 | 1–2 |
| 29 | | 15 | | 60 | — | — | 40 | 25 | 4–5 |

TABLE II

| Example No. | HCl g/l | $HNO_3$ g/l | $Al(NO_3)_3xH_2O$ g/l | Type of β-diketo compound | β-Diketo-concentration g/l | d.c. density A/dm² | time sec | quality grades 1 = very good 10 = extremely poor |
|---|---|---|---|---|---|---|---|---|
| 30 | | 15 | 60 | acetylacetone acetylacetone | 10 | 40 | 20 | 2–3 |
| 31 | | 15 | 60 | acetylacetone | 10 | 40 | 25 | 2–3 |
| 32 | | 15 | 60 | acetylacetone | 10 | 40 | 30 | 2–3 |

What is claimed is:

1. A process for the electrochemical graining of a printing plate support, comprised of aluminum or an aluminum alloy, comprising the step of subjecting an aluminum or aluminum alloy printing plate support to an electric current in a solution comprised of an acid electrolyte and at least one β-diketo compound.

2. A process as claimed in claim 1, wherein said electrolyte comprises an aqueous acid solution.

3. A process as claimed in claim 2, wherein said aqueous acid comprises hydrochloric acid or nitric acid.

4. A process as claimed in claim 3, wherein the concentration of said aqueous acid is adjusted to be in the range of about 0.01 to 50 g/l.

5. A process as claimed in claim 3, wherein the concentration of said aqueous acid is adjusted to be in the range of about 0.01 to 30 g/l.

6. A process as claimed in claim 1, wherein the concentration of said β-diketo compound is adjusted to be in the range from about 3 g/l to the saturation limit.

7. A process as claimed in claim 1, wherein the concentration of said β-diketo compound is adjusted to be in the range of about 40–400 g/l.

8. A process as claimed in claim 1, wherein said β-diketo compound comprises acetylacetone.

9. A process as claimed in claim 1, wherein at least one aluminum salt is added to said electrolyte.

10. A process as claimed in claim 9, wherein said aluminum salt comprises an aluminum salt of an inorganic acid.

11. A process as claimed in claim 10, wherein said aluminum salt of an inorganic acid comprises aluminum chloride or aluminum nitrate.

12. A process as claimed in claim 9, wherein the concentration of said aluminum salt is adjusted to be in the range of from about 20–200 g/l, based on said electrolyte.

13. A process as claimed in claim 9, wherein the concentration of said aluminum salt is adjusted to be in the range of from about 20–150 g/l, based on said electrolyte.

14. A process as claimed claim 1, wherein said electric current comprises alternating current.

15. A process as claimed in claim 14, wherein the current density of said alternating current ranges from about 3 to 130 A/dm².

16. A process as claimed in claim 14, wherein the current density of said alternating current ranges from about 30 to 130 A/dm².

17. A process as claimed in claim 1, wherein said aluminum or aluminum alloys are subjected to said electric current in said solution for a period of time ranging from about 3 to 300 seconds.

18. A process as claimed in claim 1, wherein said aluminum or aluminum alloys are subjected to said electric current in said solution for a period of time ranging from about 3 to 30 seconds.

19. A process as claimed in claim 1, wherein said electric current comprises direct current.

20. A process as claimed in claim 1, wherein said electric current comprises superimposed alternating current and low frequency currents.

* * * * *

UNITED STATES PATENT AND TRADEMARK OFFICE

CERTIFICATE OF CORRECTION

PATENT NO. : 4,671,859

DATED : June 9, 1987

INVENTOR(S) : Engelbert Pliefke

It is certified that error appears in the above-identified patent and that said Letters Patent is hereby corrected as shown below:

On the Title page, Assignee should read:

-- HOECHST AKTIENGESELLSCHAFT --

Signed and Sealed this

Twenty-seventh Day of October, 1987

*Attest:*

DONALD J. QUIGG

*Attesting Officer*

*Commissioner of Patents and Trademarks*